United States Patent [19]

Ohno et al.

[11] Patent Number: 4,624,170

[45] Date of Patent: Nov. 25, 1986

[54] ELECTRONIC MUSICAL INSTRUMENT WITH AUTOMATIC ACCOMPANIMENT FUNCTION

[75] Inventors: Hiroko Ohno; Naoaki Matsumoto, both of Tokyo, Japan

[73] Assignee: Casio Computer Co., Ltd., Tokyo, Japan

[21] Appl. No.: 744,641

[22] Filed: Jun. 13, 1985

Related U.S. Application Data

[63] Continuation of Ser. No. 532,598, Sep. 15, 1983, abandoned.

[30] Foreign Application Priority Data

Sep. 22, 1982 [JP] Japan ..... 57-142547[U]

[51] Int. Cl.[4] ..... G10F 1/00

[52] U.S. Cl. ..... 84/1.03; 84/DIG. 12; 84/1.19

[58] Field of Search ..... 84/1.03, 1.19, 1.24, 84/DIG. 12, DIG. 22, 1.28

[56] References Cited

U.S. PATENT DOCUMENTS

| | | | |
|---|---|---|---|
| 4,282,788 | 8/1981 | Yamaga et al. . | |
| 4,355,559 | 10/1982 | Uya et al. | 84/1.03 |
| 4,387,620 | 6/1983 | Okamoto et al. | 84/1.03 |
| 4,413,543 | 11/1983 | Iba | 84/1.03 |
| 4,433,601 | 2/1984 | Hall et al. | 84/1.03 |

FOREIGN PATENT DOCUMENTS

| | | |
|---|---|---|
| 3014403 | 10/1980 | Fed. Rep. of Germany . |
| 3023478 | 1/1981 | Fed. Rep. of Germany . |
| 3151607 | 7/1982 | Fed. Rep. of Germany . |
| 1380080 | 1/1975 | United Kingdom . |
| 1564823 | 4/1980 | United Kingdom . |

*Primary Examiner*—Forester W. Isen

*Attorney, Agent, or Firm*—Frishauf, Holtz, Goodman & Woodward

[57] ABSTRACT

When a desired rhythm is selected by a rhythm key group, corresponding rhythm data is set in a rhythm register in a CPU. Meanwhile, accompaniment pattern data is set in bass, backing and arpeggio registers by operation of corresponding bass, backing and arpeggio switches. The data set in the registers are supplied as address data to an arpeggio memory section, a backing memory section and a base memory section, so that corresponding rhythm data, tone color data and accompaniment data are read out.

9 Claims, 13 Drawing Figures

FIG. 6A

| RHYTHM | BASS | | | |
|---|---|---|---|---|
| | I | II | III | IV |
| ROCK | W | E | B | S |
| POPS | W | E | B | S |
| DISCO | W | E | W | S |
| 16 BEAT | W | S | E | B |
| SWING | W | W | W | E |
| LATIN SWING | W | S | B | E |
| BOSSANOVA | W | E | B | S |
| SAMBA | W | E | S | B |
| BEGUINE | W | E | B | S |
| TANGO | W | S | W | E |
| WALTZ | W | W | W | W |
| SLOW ROCK | W | W | S | B |

FIG. 6B

| RHYTHM | BACKING | | | |
|---|---|---|---|---|
| | I | II | III | IV |
| ROCK | P | G | D | O |
| POPS | D | P | O | P |
| DISCO | G | D | P | D |
| 16 BEAT | G | O | P | D |
| SWING | P | O | O | D |
| LATIN SWING | G | P | D | O |
| BOSSANOVA | P | G | D | O |
| SAMBA | G | P | D | D |
| BEGUINE | P | O | G | P |
| TANGO | O | D | P | G |
| WALTZ | D | G | D | P |
| SLOW ROCK | O | G | P | D |

FIG. 6C

| RHYTHM | ARPEGGIO | | | |
|---|---|---|---|---|
| | I | II | III | IV |
| ROCK | P | G | P | G |
| POPS | P | B | G | P |
| DISCO | G | O | P | P |
| 16 BEAT | P | G | P | G |
| SWING | P | O | P | G |
| LATIN SWING | P | O | P | B |
| BOSSANOVA | G | B | P | G |
| SAMBA | P | G | P | B |
| BEGUINE | G | P | O | G |
| TANGO | G | G | O | B |
| WALTZ | O | G | O | G |
| SLOW ROCK | P | B | O | G |

ELECTRONIC MUSICAL INSTRUMENT WITH AUTOMATIC ACCOMPANIMENT FUNCTION

This application is a continuation of application Ser. No. 532,598, filed 09/15/83, now abandoned.

BACKGROUND OF THE INVENTION

This invention relates to an electronic musical instrument, which can perform automatic accompaniment according to stored automatic accompaniment data.

A prior art electronic musical instrument having an automatic accompaniment function can perform automatic accompaniment with a specified chord according to a rhythm pattern. Storing a plurality of accompaniment patterns of different pitches and tone durations and using different accompaniment patterns for a given rhythm has been considered in the past.

In such a case, however, since only pitch and duration of accompaniment tone in the respective accompaniment patterns are varied, the tone color cannot be varied, so that the obtainable musical expression is rather monotonous and poor. For example, bass is sounded with a single bass tone color and accompaniment patterns such as backing and arpeggio are sounded by a single, monotonous tone color.

SUMMARY OF THE INVENTION

An object of the invention is to provide an electronic musical instrument, which can perform automatic accompaniment rich in variety.

According to the invention, a plurality of accompaniment pattern data and a plurality of tone color data are stored, and automatic accompaniment is performed according to the selected accompaniment pattern and the selected tone color.

According to the invention, there is provided an electronic musical instrument which comprises means for storing a plurality of different automatic accompaniment data, means for storing a plurality of different tone color data, means for selecting a desired one of said plurality of automatic accompaniment data, tone color setting means for setting each of the plurality of automatic accompaniment data in correspondence with one of the plurality of tone color data, and means for producing tone signals for automatic accompaniment corresponding to the accompaniment data and in a tone color preset by the tone color setting means.

BRIEF DESCRIPTION OF THE DRAWINGS

FIGS. 6A to 6C are views showing tone color data for respective automatic accompaniment patterns;

DETAILED DESCRIPTION OF THE PREFERRED EMBODIMENT

Figure 1:
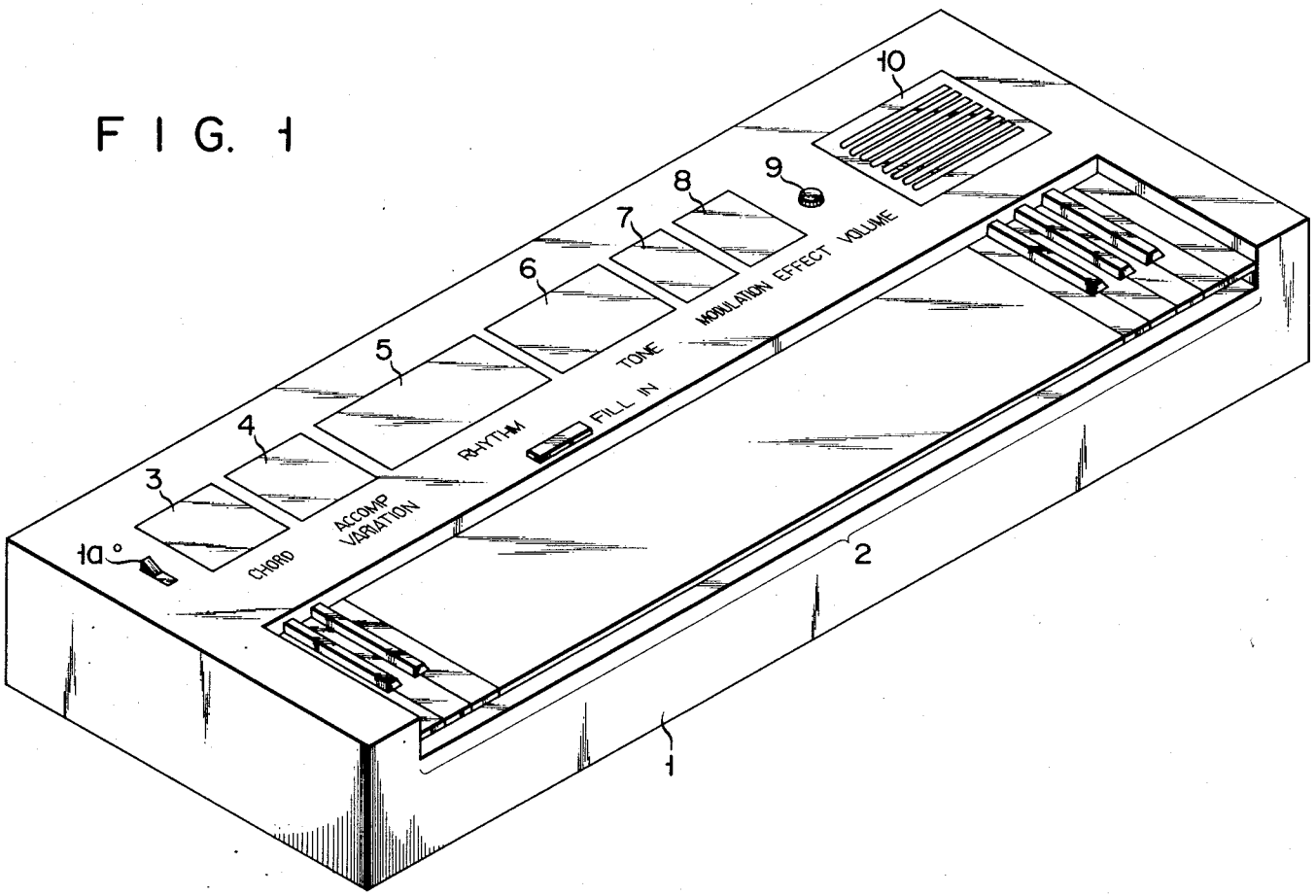
FIG. 1 is a perspective view showing an embodiment of the electronic musical instrument according to the invention.

FIG. 1 is a perspective view of an electronic musical instrument according to the invention. The instrument comprises a case 1, which has a keyboard 2 provided on a front portion of its top and has a plurality of performance keys. The case 1 also has a panel provided on a rear portion of its top. The panel has a power switch 1*a*, a chord switch section 3, an accompaniment pattern selection switch section 4, a rhythm switch section 5, a tone switch section 6, a modulation switch section 7, an effect switch section 8, and a volume knob 9 and a sound section 10 arranged in the mentioned order from the left end.

Figure 2:
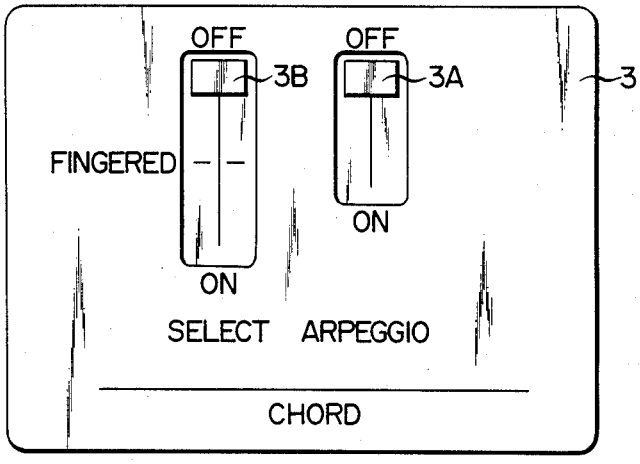
FIGS. 2 to 4 are enlarged-scale plan views showing various switch sections shown in FIG. 1.
Figure 3:
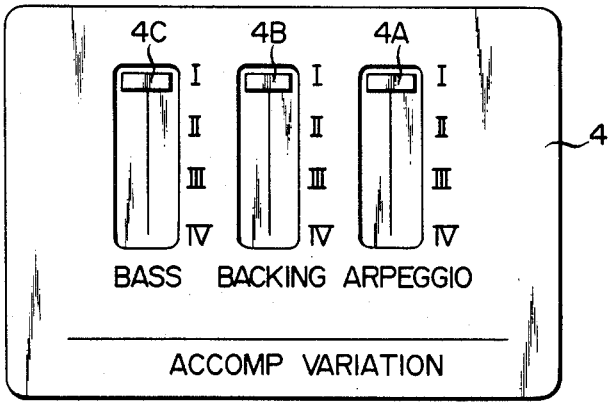

FIG. 2 shows the chord switch section 3 in detail. It has an arpeggio switch 3A and select switch 3B. The select switch 3B can select an "off" mode, a "fingered" mode and an "on" mode. In the "off" mode, automatic accompaniment cannot be produced, but music can be played manually using the keyboard 2. In the "fingered" mode, an automatic accompaniment can be produced to a rhythm and in chords corresponding to operated low octave section keys of the keyboard 2. In the "on" mode, an automatic accompaniment can be produced to a rhythm in chords specified by operating low octave section keys of the keyboard 2 using one, two, three or more fingers. The arpeggio switch 3A permits arpeggio sound based on an arpeggio pattern to be added to the accompaniment by switching the "off" mode over to the "on" mode even during the automatic accompaniment.

The accompaniment pattern selection switch section 4 has an arpeggio switch 4A, a backing switch 4B and a bass switch 4C arranged in the mentioned order from the left. The individual switches 4A to 4C can select four different patterns I to IV for the respective accompaniment patterns of arpeggio, backing and bass.

Figure 4:
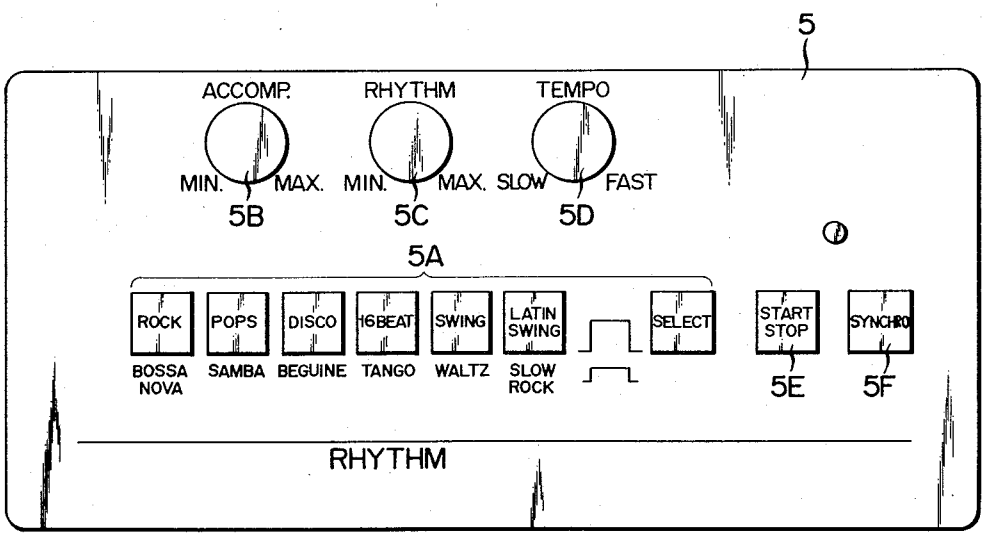

FIG. 4 shows the rhythm switch section 5. It has a rhythm key group 5A consisting of seven two-position keys, an accompaniment knob 5B, a rhythm knob 5C, a tempo knob 5F, a start/stop key 5E and a synchro key 5F. In the rhythm key group 5A, six keys can provide 12 different rhythm patterns depending on the position of a select key at the right end. In their free position, the six keys can provide respective rhythm patterns, namely, rock, pop, disco, 16 beat, swing and latin swing. In their depressed position, they can provide respective other rhythm patterns, namely bossanova, samba beguine, tango, waltz and slow rock. The knobs 5B and 5C are volume controls for the accompaniment sound and rhythm sound, respectively. The knob 5D is a tempo control knob. The start-stop key 5E is provided for starting and stopping rhythm and automatic accompaniment. The synchro key 5F is used to start automatic accompaniment to the player's performance.

The tone switch section 6 can set the tone color of music performed using the keyboard 2. For instance, it can set the tone colors of "piano", "flute", "organ", "violin", "horn" and "guitar". The modulation switch section 7 can control the envelope of the tone color set by the tone switch section 6. The effect switch section 8 can add musical effects such as vibrato and reverberation to all music such as the melody performed and accompaniment, etc. The volume control knob 9 can control the volume of all output sound.

Figure 5:
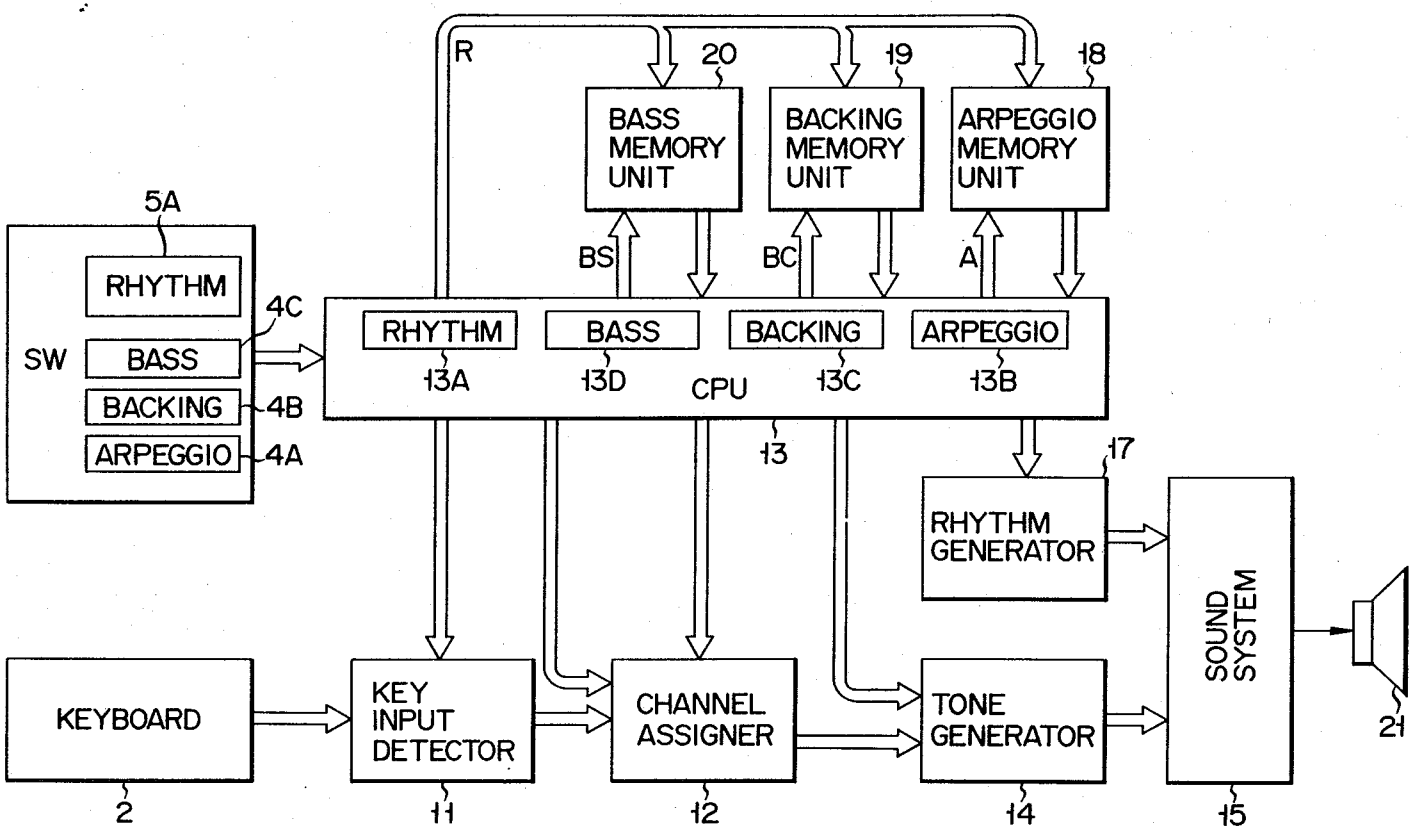
FIG. 5 is a block diagram showing the circuitry of the electronic musical instrument shown in FIG. 1.

FIG. 5 shows the circuitry of the embodiment. The keyboard 2 noted above is connected to a key input detecting section 11. A central processing unit (CPU) 13 scans the key detecting section 11 to detect operated keys of the keyboard 2 and supplies data representing the operated keys to a channel assigner 12. The channel assigner 12 assigns channels to performance key data from the keyboard 2 and accompaniment data to be described later, on a time division basis, for instance, according to an instruction from the CPU 13. For example, it can assign 4 channels at most to the performance key data and 4 channels at most to the accompaniment data so that 4 tones at most can be produced simultaneously. The performance key data and accompaniment data from the channel assigner 12 are supplied to a tone generating section 14 to be converted into tone signals, which are coupled through a sound system 15 to a loudspeaker 21 in the sound section 10.

Rhythm pattern data selected from among 12 different rhythm patterns such as rock, samba, etc. by the rhythm key group 5A noted above is set as numerical data in a rhythm register 13A in the CPU 13. When the selected rhythm pattern is changed by the rhythm key group 5A, the numerical data in the rhythm register 13A is updated correspondingly. The rhythm register 13A provides an R signal, which represents a rhythm data among various rhythm patterns corresponding to the numerical data and is supplied to an arpeggio memory section 18, a backing memory section 19 and a bass memory section 20. This R signal serves as a factor to determine the reading of various accompaniment pattern data to be described later.

Accompaniment pattern data for patterns I to IV selected by the arpeggio switch 4A, backing switch 4B and bass switch 4C noted above are also set as numerical data in the arpeggio register 13B, backing register 13C and bass register 13D in the CPU 13. These numerical data set in the registers 13B to 13D can be updated by switching the switches 4A to 4C. The registers 13B to 13D provide respective A, Bc and Bs signals, which are supplied along with the R signal from the rhythm register 13A to the arpeggio, backing and bass memory sections 18 to 20, respectively. In the memory sections 18 to 20, a plurality of different accompaniment patterns for respective rhythms and a plurality of different tone color data for piano, guitar, etc. are stored. More specifically, four different accompaniment pattern data for each of 12 different rhythms, i.e., a total of 48 different accompaniment pattern data, and tone color data individually corresponding to the respective accompaniment pattern data, are stored. The accompaniment pattern data and tone color data are read out according to the R signal and A, Bc and Bs signals. Of these data, the accompaniment tone color data is supplied as a tone color designation signal to the tone generating section 14. In the tone generating section 14 tone color data are stored, and they are read out according to the supplied tone color designation signal. The accompaniment pattern data is supplied through the CPU 13 to the channel assigner 12 and thence supplied with channels assigned thereto to the tone generating section 14. The tone generating section 14 converts this data into tone signals of the designated tone color. The tone signals are supplied to the sound system 15 and emitted as sound from the loudspeaker 21.

FIGS. 6A to 6C, and 7 to 11 illustrate in detail tone color data for automatic accompaniment.

As has been mentioned earlier, a total of 48 accompaniment pattern data, i.e., four different patterns for 12 different rhythms, for bass, backing and arpeggio and also tone color data for the respective accompaniment patterns, are stored in the bass, backing and arpeggio memory sections 20, 19 and 18. FIG. 6A shows tone color data for the different accompaniment patterns stored in the bass memory section 20. Here, detailed accompaniment pattern data are not shown. In the table of FIG. 6A, W represents "wood bass", E "electric bass", B "brass", and S "synthesizer". For example, with the rock rhythm the tone color of "wood bass" corresponds to "bass I", and with the disco rhythm the tone color of "synthesizer" corresponds to "bass IV".

FIG. 6B shows tone color data stored in the backing memory section 19. In this Table, P represents "piano", G "guitar", D "electronic sound", and O "organ". FIG. 6C shows tone color data stored in the arpeggio memory section 18. Like the case of FIG. 6B, P represents "piano", G "guitar", and O "organ".

Figure 7:
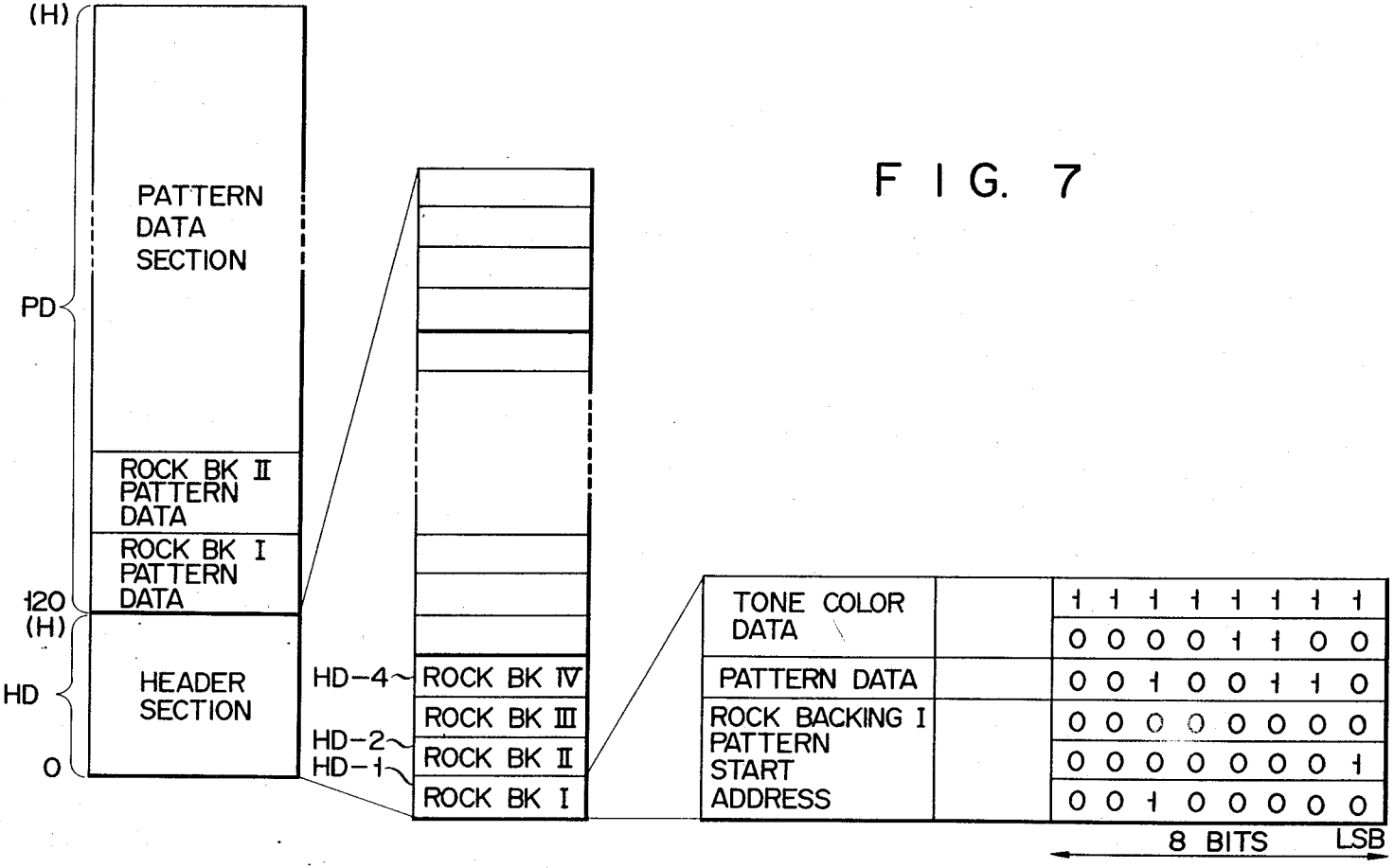
FIG. 7 is a data format diagram for explaining the method of storing tone color data in the electronic musical instrument.

FIG. 7 shows the format of backing pattern data and backing tone color data stored in the backing memory section 19. A pattern data section PD and a header section HD as shown in FIG. 7 are successively stored in the memory section 19. Each data has an 8-bit structure, and its memory area address is represented by a hexadecimal address data. The header section HD has a plurality of headers HD-1, HD-2, . . . Each header, for instance the header HD-1 for "backing I" for the rock rhythm, consists of 8-bit 2-line tone color data, 8-bit pattern data and 3-line pattern start address data for "backing I" of the rock rhythm. These data are stored separately.

Figure 8:
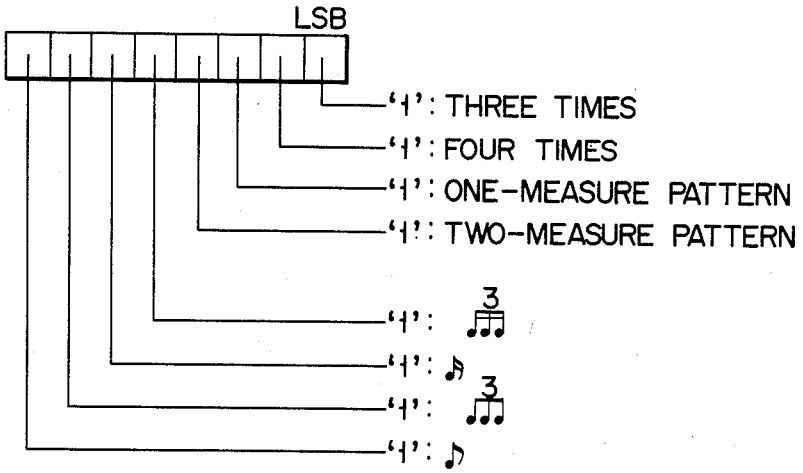
FIG. 8 is a data format diagram showing pattern data.

FIG. 8 shows the configuration of the 8-bit pattern data. The (1) three time, (2) four time, (3) single bar, (4) double bar, (5) semiquaver triplet, (6) semiquaver, (7) quarter note triplet and (8) quarter note are represented by respective "1" bits from the least significant bit to the most significant bit, respectively.

Figure 9:
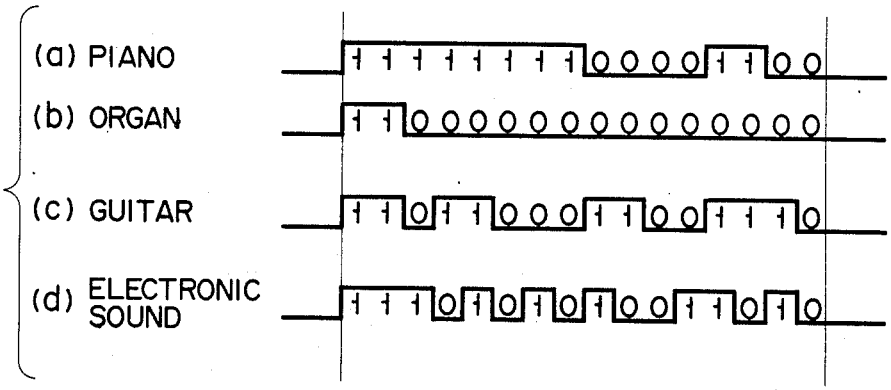
FIG. 9 is a view showing tone color data for backing.
Figure 10:
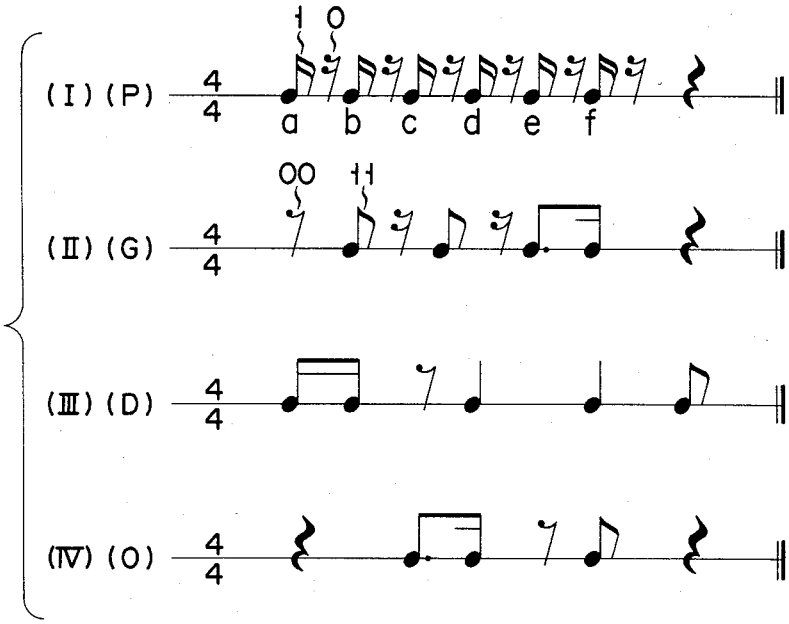
FIG. 10 is a view showing rock patterns of different rhythms.

FIG. 9 shows the backing tone color data. These data are 16-bit data consisting of "1" and "0" bits. The tone color data for "piano" is "1111111100001100". The data for "organ" is "1100000000000000". The data for "guitar" is "1101100011001110". The data for "electronic sound" is "1110101010011010". As an example, the "backing I" to "backing IV" for the rock rhythm in FIG. 6B correspond to the "piano" (P), "guitar" (G), "electronic sound" (D) and "organ" (0) tone color data, respectively. FIG. 10, shows the data of the "backing I" to "backing IV". The "backing I" pattern, for instance, consists of alternate (9) semiquavers and (10) 1/16 rest in the tone color of "piano". Its binary expression is "1010101010100000". The "backing II" pattern is "0011010011110000" in the "guitar" tone color.

Figure 11:
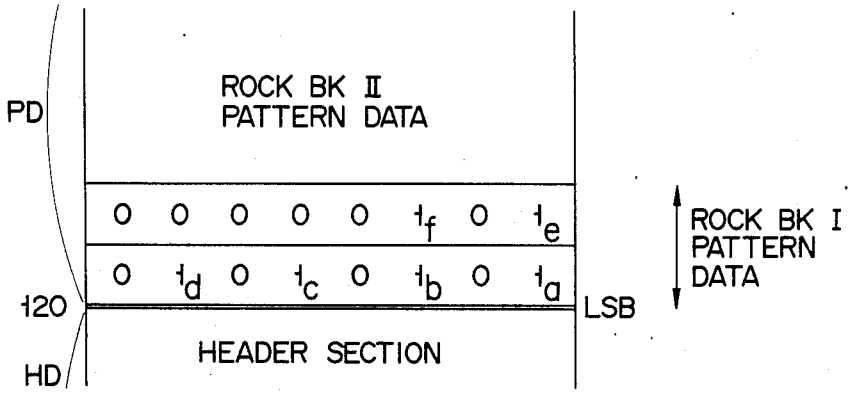
FIG. 11 is a view showing part of a pattern data section in the data format shown in FIG. 7.

FIG. 11 shows the accompaniment pattern data for "backing I" for rock as shown in (I) in FIG. 10, stored at the starting portion of the pattern data section PD which is after the header section HD. The data is a 16-bit data arranged from LSB to MSB as "1010101010100000" in which notes are represented as "1" and rests are represented as "0". Suffixes a to f of the individual "1" bits in FIG. 11 represent the semiquavers, and they correspond to the symbols a to f shown in (I) in FIG. 10.

In operation, the desired accompaniment rhythm is selected by operating a rhythm key group 5A with the select switch 3B in the "ON" position and the arpeggio switch 3A in the "OFF" position. When rock is selected, for instance, rhythm name data for "rock" is set in the rhythm register 13A. This data is supplied as the R signal to the bass memory section 20, backing memory section 19 and arpeggio memory section 18.

Afterwards, the desired accompaniment pattern is set by operating the arpeggio switch 4A, backing switch 4B and bass switch 4C. When the bass switch 4C is set to position I, backing switch 4B to position II and arpeggio switch 4A to position III, for instance, data "I" is written in the bass register 13D, data "II" in the backing register 13C, and data "III" in the arpeggio register 13B. These data are supplied respectively as Bs, Bc and A signals to the bass, backing and arpeggio memory sections 20, 19 and 18. When the start/stop key 5E in the rhythm switch section 5 is operated, only the rhythm sound of rock is produced according to the rhythm pattern of rock generated from the rhythm generator 17. When the start/stop key 5E is operated once again, the generation of the rhythm sound is stopped. When the synchro key 5F is operated and also a key in the low octave portion of the keyboard 2 is operated, the corresponding chord accompaniment is started to the rhythm of rock.

More specifically, in response to the operation mentioned, the bass memory section 20 is addressed by the R signal from the rhythm memory section 13A and the Bs signal from the bass register 13D, and supplies bass pattern data for "rock I" and tone color data for "wood bass" to the CPU 13. Likewise, the backing memory section 19 supplies backing pattern data for "rock II" and backing tone color data for "guitar" to the CPU 13. The CPU 13 supplies each accompaniment tone to the channel assigner 12, while supplying the bass and backing tone data to the tone generating section 14 and rhythm data to the rhythm generating section 17. The channel assigner 12 assigns channels to the supplied bass and backing tone data, and supplies these data to the tone generating section 14 with indication data as to whether the tone data is for bass or backing. The tone generating section 14 generates the bass tone data for wood bass and backing tone data for guitar from the bass and backing tone data supplied from the channel assigner 12, according to each tone color data supplied from the CPU 13 and supplies these tone data to the sound system 15. The rhythm generating section 17 generates the specified rhythm pattern data for rock and supplies it to the sound system 15. The sound system 15 combines and amplifies the tone data and rhythm pattern data, and the resultant signal is emitted as sound from the loudspeaker 21 in the sound section 10.

When the arpeggio switch 3A is switched to the "on" position, the output of the backing memory section 19 is stopped and, instead, the arpeggio memory section 18 starts to supply the arpeggio pattern data for "rock III" and arpeggio tone color data for "piano" to the CPU 13. Of these data, the arpeggio pattern data is supplied along with the bass pattern data noted above to the channel assigner 12, and conversion to predetermined music is effected according to the bass and arpeggio tone color data supplied to the tone generating section 14. When the rhythm key 5A or three switches 4A to 4C are desirably switched while the accompaniment is being produced, the pattern of the accompaniment is immediately changed. At this moment, new data are supplied to the registers 13A to 13D, and corresponding new rhythm data, tone color data and accompaniment data are read out. The tone color of the accompaniment can be varied desirably in the above manner.

As has been described in the foregoing, according to the invention a plurality of accompaniment pattern data and a plurality of tone color data are stored, and automatic accompaniment can be produced according to a selected accompaniment pattern and in a selected tone color. Thus it is possible to obtain automatic accompaniment which is rich in variety.

What is claimed is:

1. An electronic musical instrument, comprising:

means for manually selecting a desired one of different kinds of rhythms;

first means for storing a plurality of different automatic accompaniment pattern data;

means for manually selecting one of a plurality of automatic accompaniment patterns associated with the kind of rhythm selected by said rhythm selecting means;

second means for storing different preset tone color data for designating a tone color of automatic accompaniment tones to be produced in correspondence with each of said plurality of different automatic accompaniment pattern data stored in said first means;

means for reading out the selected automatic accompaniment pattern data and the preset tone color data stored in correspondence with said selected automatic accompaniment pattern data; and means for producing tone signals for automatic accompaniment, said tone signals corresponding to the selected one of said plurality of different automatic accompaniment pattern data and the tone color data read out in correspondence with said selected automatic accompaniment pattern data.

2. An electronic musical instrument according to claim 1, comprising:

third means for storing a plurality of rhythm patterns; and wherein said first means stores a plurality of accompaniment pattern data for each of said plurality of rhythm patterns stored in said third means, and said producing means produces the tone signals according to the selected rhythm pattern.

3. The electronic musical instrument according to claim 2, wherein said first means for storing automatic accompaniment pattern data includes a bass memory section, a backing memory section and an arpeggio memory section.

4. The electronic musical instrument according to claim 3, wherein said automatic accompaniment pattern data selecting means includes an accompaniment pattern selection switch section having a bass switch, a backing switch and an arpeggio switch for said bass memory section, backing memory section and arpeggio memory section.

5. The electronic musical instrument according to claim 4, wherein said tone color storing means includes:

a rhythm register for setting rhythm data corresponding to a rhythm pattern selected by the rhythm pattern selecting means; and an arpeggio register, a backing register and a bass register for setting accompaniment pattern specification data selected by said arpeggio, backing and bass switches respectively; and wherein said preset tone color data corresponding to a given accompaniment pattern is read out from said arpeggio, backing and bass memory sections according to data stored in said rhythm, arpeggio, backing and bass registers.

6. The electronic musical instrument according to claim 5, wherein said bass, backing and arpeggio memory sections each include a pattern data section and a header section, and a start address of an accompaniment data corresponding to each of the rhythm patterns stored in said rhythm pattern storing section, and a plurality of tone color data of the corresponding accompaniment tone data, are stored in said header section.

7. An electronic musical instrument, comprising:

first manually selecting means for manually selecting a desired one of a number of different kinds of rhythms;

accompaniment pattern storing means for storing a plurality of automatic accompaniment pattern data;

second manually selecting means for selecting from said accompaniment pattern storing means, one of said plurality of automatic accompaniment pattern data with respect to the desired one of said different kinds of rhythms selected by said first manually selecting means;

tone color setting means for setting a tone color in correspondence with the kind of rhythm selected by said first manually selecting means;

a keyboard including a plurality of performance keys; and tone producing means for producing tone signals for automatic accompaniment according to the operation of said performance keys and also according to the automatic accompaniment pattern data selected by said second manually selecting means, said tone producing means being operative to produce the accompaniment tones with a tone color determined by said tone color setting means.

8. An electronic musical instrument according to claim 7, wherein said accompaniment pattern memory means includes a bass memory section, a backing memory section and an arpeggio memory section, and said bass memory section is arranged to store a plurality of bass pattern data, said backing memory section is arranged to store a plurality of backing pattern data, and said arpeggio memory section is arranged to store a plurality of arpeggio pattern data.

9. An electronic musical instrument according to claim 7, comprising:

rhythm pattern storing means for storing a plurality or rhythm pattern data;

said first manually selecting means selecting one of the rhythm pattern data from said rhythm pattern storing means in accordance with the desired kind of rhythm; and said tone producing means including rhythm sound producing means for producing a rhythm sound according to the rhythm pattern data selected by said first manually selecting means.

* * * * *